US008572773B1

(12) United States Patent
Clayton

(10) Patent No.: US 8,572,773 B1
(45) Date of Patent: Nov. 5, 2013

(54) WASH BASIN WITH VALVE FOR SELECTIVE FAUCET AND CASCADE FLOWS

(71) Applicant: Keith K. Clayton, Chicago, IL (US)

(72) Inventor: Keith K. Clayton, Chicago, IL (US)

( * ) Notice: Subject to any disclaimer, the term of this patent is extended or adjusted under 35 U.S.C. 154(b) by 0 days.

(21) Appl. No.: 13/675,244

(22) Filed: Nov. 13, 2012

(51) Int. Cl.
*A47K 1/04* (2006.01)

(52) U.S. Cl.
USPC ..... 4/650

(58) Field of Classification Search
USPC ..... 4/679, 650, 675, 619, 671, 538–595
See application file for complete search history.

(56) References Cited

U.S. PATENT DOCUMENTS 1,426,046 A * 8/1922 Cohen ..... 4/653
4,231,123 A * 11/1980 Cheng ..... 4/651
6,618,874 B2 * 9/2003 Gerloff ..... 4/650
6,836,910 B2 * 1/2005 Cawthon ..... 4/650
7,458,112 B1 * 12/2008 Yang ..... 4/601
7,503,083 B2 * 3/2009 Ball ..... 4/650
7,665,160 B1 * 2/2010 Linder ..... 4/650
7,857,241 B2 * 12/2010 Deng ..... 239/444
7,954,183 B2 * 6/2011 Cawthon ..... 4/650
2012/0151672 A1 * 6/2012 Bucher ..... 4/650
2013/0047332 A1 * 2/2013 Mirabito ..... 4/650

* cited by examiner

*Primary Examiner* — Lori Baker
(74) *Attorney, Agent, or Firm* — Crossan IP Law, LLP; John R. Crossan

(57) ABSTRACT

A method and system for selectively providing a contemporary sink or basin with a cascading water flow over the inside surface of the sink or basin, in addition to a flow of wash water into the basin itself. The sink or basin is provided in two parts, connected about the drain passage. Wash water is flowed into the bowl from above, and cascade water is introduced into a reservoir between the lower, base part and an upper, insert part. A narrow gap between the lower and upper parts lets water flow over the edge of the insert and along the sides of the basin, washing away detritus falling there such as toothpaste and shaving lather. Temperature and volume of the water are controlled for instance by a first valve, and a second valve controls flow into the basin from the faucet and/or from the reservoir.

6 Claims, 1 Drawing Sheet

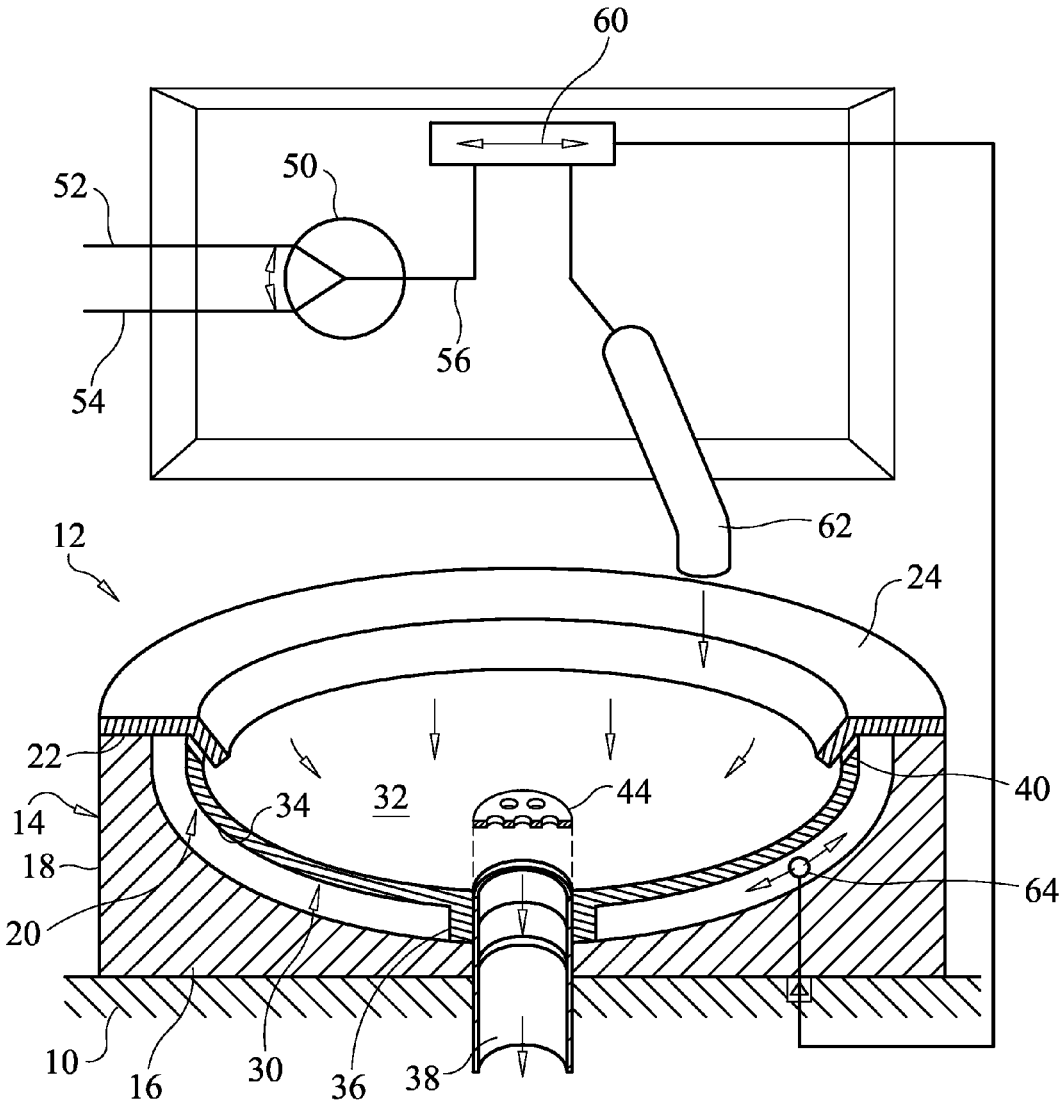
60
50
52
54
56
62
12
24
22
14
18
20
34
32
44
40
64
10
16
30
36
38

WASH BASIN WITH VALVE FOR SELECTIVE FAUCET AND CASCADE FLOWS

FIELD OF THE INVENTION

The present invention relates to wash basins for domestic use, particularly in contemporary design settings and having no drain stopper built in.

BACKGROUND OF THE ART

Wash basins, bowls, and sinks continue to be a common domestic and household feature for bathrooms and powder rooms, being set on, held beneath, or mounted at their upper rims onto a countertop and equipped with hot and cold water controls and a single faucet, an overflow passage, and a bottom drain with a closable stopper. More recently, the faucet is mounted above the basin, separate from the basin, with no apparent connection to the sink but flowing water into the receptacle from above. Such sinks, basins, and bowls occasionally, and now more commonly, are formed as were old-time simple basins or bowls, like a porcelain bowl that was simply set atop a surface without plumbing, but the new ones actually have running water and a drain.

All such basins and sinks, apart from the device of my U.S. Pat. No. 6,353,944, suffer the problem that soap, dirt, toothpaste, hair, shaving cream, and other detritus from users often drops onto and stays on the surface of the basin or sink. The detritus must then be separately washed away by the user, unless it happens to fall into the flow from the faucet itself, but that flow is not intended to cover all the inside surface of the basin or sink. Where the detritus is not separately rinsed away, it can be very unappealing and unsanitary to users who come later. When the detritus dries, it can become difficult to remove without use of specific cleaning products or tools.

Although sinks have been known with similar structures or intended functions, none has provided the functions desired in an aesthetically pleasing and fully functional way. Cheng U.S. Pat. No. 4,231,123 shows a plurality of separate inlet and overflow slots formed about the upper, inner periphery of an inset sink structure, with temperature controls for the inlet water, but no separate, main water inlet; that is, all water comes into the basin through the peripheral inlets, as in a toilet or dentist's spittle receptacle with whirling flow. U.S. Pat. No. 913,323 shows separate cocks for introducing water to a public washbasin and a whirling internal flow through jets 13. Cohen U.S. Pat. No. 1,426,046 is similar, for a sink or bath tub. Three- and four-way valves are known, as from U.S. Pat. Nos. 7,857,241 and 7,458,112, for different purposes.

SUMMARY OF THE INVENTION

This invention provides a simple but attractive wash basin and valve combination to selectively supply water into the basin from a faucet above and/or a cascading flow downwardly around the entire basin surface for cleaning that surface, as desired. The basin has a first part comprising an outer peripheral wall and a base forming a reservoir and a second part comprising an insert forming the basin itself. The insert fits inwardly of the peripheral wall and atop the base, leaving a narrow space between the top outer edge of the insert and the inside of the peripheral wall, allowing an overflow of water from the reservoir and over the entire upper, inner surface of the basin insert. A drain passage at the bottom of the basin communicates through the base to a drain and is always open to drain water even at maximum flow from the faucet and cascade. The valve is a 3- or 4-way valve of any desired construction that is simple for a user to operate to (1) shut off all water flow, (2) flow water only into the sink from the faucet, or (3) flow water only into the cascade, and optionally (4) to flow water into both the faucet and the cascade. Another valve controls the mix of hot and cold supply water and perhaps the volume of same.

BRIEF DESCRIPTION OF THE DRAWING

The one drawing FIGURE is a schematic view, with the basin and insert in section, of the plumbing and construction of a wash basin and valve combination encompassing one form of the invention.

THE PREFERRED EMBODIMENTS

In a typical domestic bath- or powder-room environment, a vanity top 10 supports a wash basin 12, both shown in section. A first part 14 of the basin 12 comprises a lower base surface 16, an outer peripheral surface 18, an upward inner surface 20, and a peripheral top edge 22. The upper edge 22 is preferably fitted in waterproof relation with a circumferential flow deflector rim 24 arranged to keep the water that is selectively flowing up the inner wall 20 from splashing a user of the wash basin 12. Typically the water flowing through the gap will simply move down the upper surface of the basin 12 without spraying, due to control of the volume and pressure of the water inlet to the flow channel, like a hose end in the bottom of a bucket. By the time the water level rises to the top of the basin, as in the bucket, it simply overflows. A larger reservoir may be provided if desired within the structure inwardly of the peripheral wall.

A second part of the basin 12 is an insert 30 that is fitted within the first part 14 of the basin 12, having upper and lower surfaces 32 and 34, respectively. Insert 30 has a base 36 that engages, preferably but optionally, in water-tight relation with the upper surface 20 of the first part 14, about a drainage aperture 38 formed in and through the base 16 of the first part 14, as shown. A top outer edge 40 of the insert 30 is arranged to be spaced a desired, generally uniform distance from the inner wall 20 of the first part 14 of the basin 12, beneath the circumferential flow deflector 24.

A drain cover 44 is provided over the drainage aperture 38 that is formed through the base 36 of the insert and the base 16 of the first part of the basin 12. The cover 44 is always open to the flow of water up to whatever maximum rate is provided for admitting water into the basin 12. Having the drain cover always open avoids the need for a separate overflow circuit around a drain stopper, as is often required for conventional, closeable-drain sinks or basins. A perforated cover 44 is shown, but any attractive cover, as a dome allowing radially inward flow to the drain passage 38, is useful in this environment.

Water is provided into the basin 12 through a temperature control valve 50 which mixes hot and cold water from domestic supply lines 52 and 54, as is well known. This valve 50 may be a simple manually adjustable valve or pair of valves, or it may be any temperature control valve of mechanical or electrical nature which seeks to provide a constant temperature of water at its outlet 56 despite variation in inlet temperatures and pressures of the supply lines 52 and 54.

The outlet 56 from the temperature control valve 50 feeds to a further valve 60 that controls where the water flows. This valve 60 is, in accordance with principles of the invention, either a 3-way or a 4-way valve of any desired form, whether a spool valve, electrical solenoid valves, or the like. A 3-way valve 60 provides water selectively to neither or to either of the basin interior 32 via faucet 62 or to a cascade inlet 64 as shown. A 4-way valve would allow flow also to both the faucet 62 and the cascade inlet 64. The amount or volume of the flows needs to be controlled or limited so as not to exceed the flow capacity of the drain cover 44 and the drain passage 38. This can be accomplished by imposing a limit on flow either through the temperature control valve 50 or the further valve 60, as by tilting a handle forwardly to increase the flow rather than moving it to one side or the other to adjust the temperature or to direct the flow to the faucet 62 or to the cascade 64.

In use, the supply lines 52 and 54 provide hot and cold water under domestic pressure to valve 50, which mixes the water to a desired temperature at outlet 56. This valve 50 also optionally controls the total rate of the water flow into the basin 12. Flow from the valve 50 goes to the further valve 60, which shuts the water flow off or sends it to either of the faucet 62 and the cascade supply 64. If the valve 60 is a four-way valve, flow may be directed both to the faucet 62 and the cascade inlet 64 simultaneously, in a pre-set or an adjustable ratio of volume flow to each. Water from the faucet 62 is used in a conventional way, to wet a toothbrush or to wash hands or faces. Water from the cascade inlet 64 fills the space between the first part 12 and the insert 30 and then flows over the edge 40 and down the upper surface 32 of the basin insert. The cascading water carries away toothpaste, shaving cream, and other detritus to and through the drain cover 44 and out the drain passage 38. Temperature of the water is controlled at valve 50 and the water volume is controlled there or at valve 60, according to how the system is set up and configured. When use is done, the cascade 64 can be run longer than the flow from the faucet 62 to ensure cleaning of the basin, if desired. All water flow can then be shut off at the valve 60.

The basin and system of this invention of course can be of any shape, depth, and size, constructed of most any solid and formable material, and can be used in any and all of commercial, residential, health care, sports and exercise facilities, and other environments.

Many variations may be made in the invention as shown and its manner of use, without departing from the principles of the invention as described herein and/or as claimed as my invention. For instance the circumferential flow diverter 24 can be made in any suitable material and color for a decorative accent atop the ceramic or other material basin parts 12 and 30, or it can be omitted to provide an "infinity edge" appearance. An added control can be placed in the exit lines from the valve 60 to control the ratio of water flowing to the faucet 62 versus the cascade inlet 64. A small drainage aperture may optionally be provided between the space between the walls 20 and 34 into the drain 38, so that water does not stand endlessly in that space, although presence of such an aperture would delay start of the cascade until the space fills up. An anti-backflow valve can be provided in the line between the valve 60 and the cascade inlet 64, if required by local code or as a matter of practice. Minor variations such as these will not avoid use of the invention.

I claim as my invention:

1. A wash basin and valve combination, the valve providing the basin selectively with water from a faucet having an outlet above upper, inner surfaces of the wash basin and with water to cascade down those surfaces of the basin, the basin being adapted to be mounted on a cabinet or pedestal as in a domestic bath or powder room and the valve providing water selectively to at least one of the faucet and the cascade, the combination comprising:

a wash basin comprising:

a base and an upstanding periphery joined together in water-tight relation and the periphery having a top inner surface;

a cascade water inlet formed in one of said base and said periphery;

a water outlet passage formed though the base to a drain;

a basin insert that fits inside the wash basin base and periphery and has a lower base and a top rim thereabout, said top rim of the insert having a selected spacing around said top from said inner surface of the periphery of the basin;

said base of the insert fitting around the water outlet passage of the base; and the basin insert providing a water reservoir space between an outer surface of the insert and inner surfaces of the basin base and periphery and a flowage path across its top from the reservoir to the upper inside surface of the basin insert; and a valve system selectively directing a flow of water from a source to either or neither of the faucet and the cascade inlet, whereby the wash basin and valve provides wash water selectively from the faucet only, cascading water only, or from neither.

2. The wash basin and valve combination as defined in claim 1, wherein the valve system is adapted selectively to direct flows of wash water to both of the faucet and the water cascade inlet simultaneously.

3. The wash basin and valve combination as defined in claim 1, wherein the top of the periphery of the base and periphery is fitted with a cover adapted to direct the cascade flow inwardly and downwardly onto the upper surface of the basin insert.

4. A wash basin adapted to having a flowing sheet of water selectively cascading downwardly across an upper surface thereof from a top of the basin to a drain at a lowermost portion thereof, the basin being formed as an outer part and an inner part, the outer and inner parts having a space formed between them providing a water reservoir, the space being substantially closed at the bottom and open at a top portion thereof inwardly of the outer part of the basin;

an inlet port connected to admit water under pressure to the space between the outer and inner parts of the basin and to fill and overflow water from the space and onto the upper surface of the inner part of the wash basin; and an outlet at the bottom of the basin and passing through the inner and outer parts adapted for emptying water from the basin.

5. The wash basin as defined in claim 4, the basin further comprising an outlet cover spaced vertically from the inner part of the basin at the top edge thereof, to prevent water in the space from passing upwardly from the outer portion of the basin but directing it to the inner surface of the inner part of the basin to flow downwardly thereon.

6. The wash basin as defined in claim 4, wherein the outer periphery of the basin is substantially rounded in plan view.

* * * * *